United States Patent [19]

Armstrong

[11] Patent Number: 4,518,200

[45] Date of Patent: May 21, 1985

[54] SEAT PAD WITH ADJUSTABLE LUMBAR SUPPORT

[76] Inventor: William H. Armstrong, 2552 Hampshire, SE., Grand Rapids, Mich. 49506

[21] Appl. No.: 425,327

[22] Filed: Sep. 28, 1982

[51] Int. Cl.[3] ..... A47C 27/08

[52] U.S. Cl. ..... 297/284; 297/DIG. 3

[58] Field of Search ..... 297/284, 230, DIG. 3, 297/460; 5/465, 446, 447

[56] References Cited

U.S. PATENT DOCUMENTS

| | | | |
|---|---|---|---|
| 2,684,672 | 7/1954 | Summerville | 297/284 |
| 2,734,556 | 2/1956 | Hebrank . | |
| 2,831,533 | 4/1958 | Pasquarelli . | |
| 3,014,761 | 12/1961 | Otto | 297/230 |
| 3,145,054 | 8/1964 | Sopko, Jr. | 297/284 |
| 3,258,259 | 6/1966 | Bohlin . | |
| 3,279,849 | 10/1966 | Radke et al. | 297/284 |
| 3,326,601 | 6/1967 | Vanderbilt . | |
| 3,463,544 | 8/1969 | Froelich . | |
| 3,608,960 | 9/1971 | Sherman . | |
| 3,678,520 | 7/1972 | Evans | 297/284 |
| 3,807,794 | 4/1974 | Beyer . | |
| 3,890,000 | 6/1975 | Easley . | |
| 3,948,558 | 4/1976 | Obermeier et al. . | |
| 3,973,797 | 8/1976 | Obermeier et al. . | |
| 3,974,827 | 8/1976 | Bodeen . | |
| 4,019,777 | 4/1977 | Hayashi . | |
| 4,097,087 | 6/1978 | Garavaglia . | |
| 4,148,522 | 4/1979 | Sakurada et al. . | |
| 4,153,293 | 5/1979 | Sheldon . | |
| 4,156,544 | 5/1979 | Swenson et al. . | |
| 4,161,337 | 7/1979 | Ross . | |
| 4,162,807 | 7/1979 | Yoshimura . | |
| 4,182,533 | 1/1980 | Arndt et al. . | |
| 4,190,286 | 2/1980 | Bentley . | |
| 4,239,282 | 12/1980 | White . | |
| 4,295,681 | 10/1981 | Gregory . | |
| 4,296,965 | 10/1981 | Sakurada et al. . | |
| 4,382,306 | 5/1983 | Lickert | 5/465 |

FOREIGN PATENT DOCUMENTS

| | | | |
|---|---|---|---|
| 140544 | 9/1934 | Austria | 5/432 |
| 435730 | 9/1935 | United Kingdom | 297/284 |
| 1299789 | 12/1972 | United Kingdom | 297/284 |

*Primary Examiner*—Victor N. Sakran
*Assistant Examiner*—Mark W. Binder
*Attorney, Agent, or Firm*—Price, Heneveld, Huizenga & Cooper

[57] ABSTRACT

A portable seat pad of the seat and back element type said back element having an inflatable bladder removably mounted for adjustment vertically along the outer side thereof. The back element is sufficiently rigid along its peripheral edges for making it self-supporting but the body portion is sufficiently flexible so that the force of the bladder deforms the body to form a lumbar support in the body portion. The adjustment is preferably accomplished by a hooked and napped loop tape means mounted on the outer side of the back element and on the inner surface of the bladder. Further, a cover is provided to cover the outer surface of the back and assist in holding the bladder in place. Preferably hooked and napped loop means secures the cover to the back.

10 Claims, 6 Drawing Figures

SEAT PAD WITH ADJUSTABLE LUMBAR SUPPORT

This invention relates to a portable seat pad with adjustable lumbar support of the type that is supported on another seat such as on an automobile seat.

BACKGROUND OF THE INVENTION

For some time, efforts have been made in the art to produce a portable device which will give support to the lumbar region of a person when he or she is in a sitting position. Efforts such as disclosed in the U.S. Pat. Nos. 3,947,827 issued Aug. 17, 1976 to Bodeen; 2,931,533 issued Apr. 22, 1958 to Pasquarelli; 3,326,601 issued June 20, 1967 to Vanderbilt et al; 4,190,286 issued Feb. 26, 1980 to Bentley; 4,097,087 issued June 27, 1978 to Garavaglia; and 2,734,556 issued Feb. 14, 1956 to Hebrank are some of the attempts to produce seating to relieve back fatigue and give better support to the lumbar region of the spine. The problems with these devices are that they are either too complicated, too expensive, not sufficiently adjustable, or do not give that degree of compatibility and comfort for different sizes of persons.

SUMMARY OF THE INVENTION

Accordingly, the present invention is constructed to provide a portable seat pad which can be easily adjusted both in the vertical position of the lumbar support and in the amount of the support.

This invention is also intended to provide a seat pad with an aesthetically pleasing appearance that can be compacted and easily carried from one location to the other, can be easily adjusted, and is still relatively inexpensive to manufacture so that it can be sold at a reasonable price making it available to large numbers of different shapes and sizes of the users.

These objects are obtained by providing a seat pad with a seat element and a back element pivotally secured together along the juncture formed at the rear edge of the seat element and the lower edge of the back element. Each of the seat and back elements have an inner surface which faces the occupant when seated on the seat pad and an outer surface which faces the support on which the seat pad is to be supported. Secured to the outer surface of the back element is an elongated air inflatable bladder, the securement means being adjustable from the lower edge to the upper edge for removably supporting the bladder at different selected positions between the edges. A cover is provided for the outer surface of the back element covering the bladder and holding it in any one of the selected positions. The back element is sufficiently rigid to be self-supporting in a vertical position but sufficiently flexible in its body so as to flex in response to pressure exerted by the inflatable bladder when the seat pad is placed on a seat and an occupant sits in the pad. Thus, the seat pad provides additional support to the lumbar region of the occupant's back, such support being locatable at the proper position and also being adjustable by the amount of air blown into the bladder.

BRIEF DESCRIPTION OF THE DRAWINGS

These and other features and objects of the invention are more clearly discussed hereinafter in connection with the accompanying drawings in which.

DESCRIPTION OF THE PREFERRED EMBODIMENTS

Figure 1:
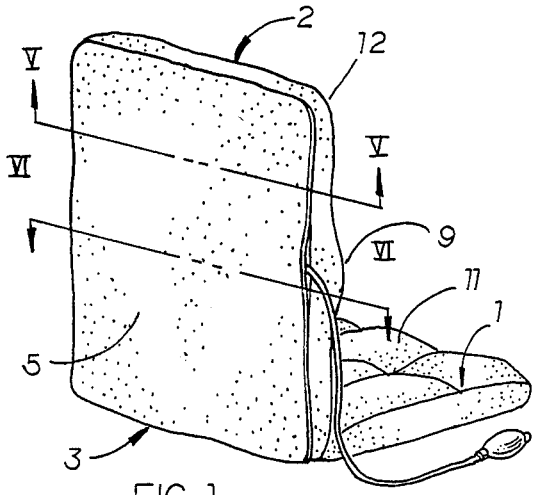
FIG. 1 is a perspective view of the back from one of the seat pads of this invention in its normal position, such as in a vehicle.

Referring more specifically to the drawings, seat pad includes a seat element 1 and a back element 2 which are hingedly mounted together along the seam 3 so that the back element 2 can be folded over onto the seat element 1 to provide an easily portable unit that can be carried from one location to another. An inflatable elongated bladder 4 is mounted on the outer surface of the back element 2 and secured over the outer surface of the back element 2. Over the bladder is the cover 5 which is secured to the outer surface of the back element 2 along its marginal edge.

Figure 6:
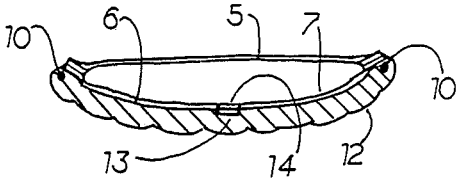
FIG. 6 is a cross-sectional view taken along the plane VI—VI of FIG. 1 showing the lumbar support section of the seat.
Figure 2:
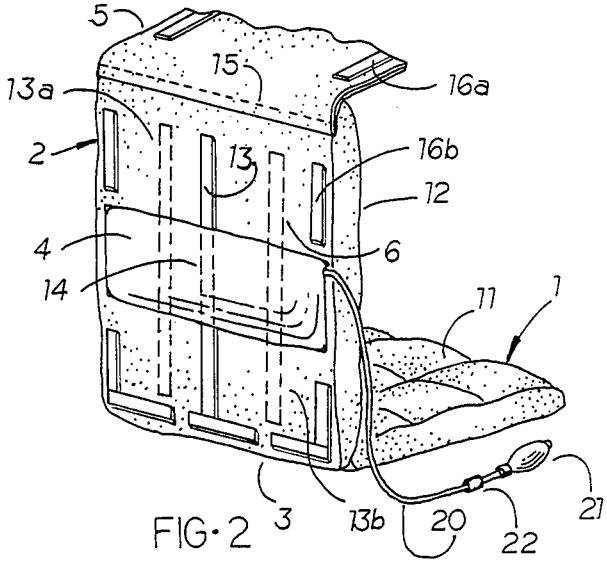
FIG. 2 is another perspective view similar to that of FIG. 1 showing the inflatable lumbar support and the means for securing the same to the outer surface of the back element.
Figure 3:
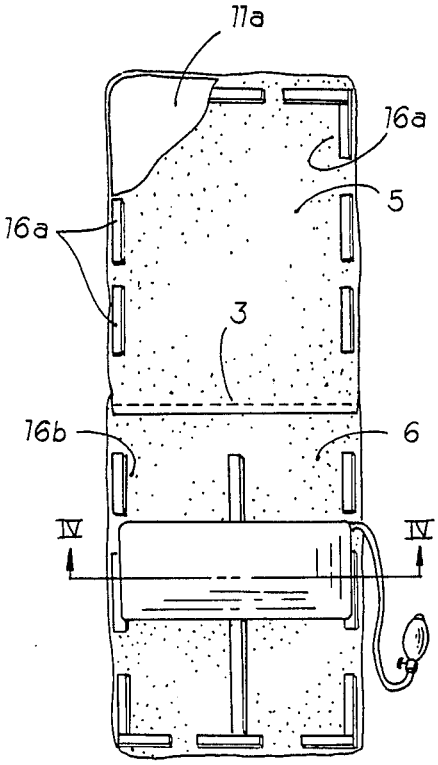
FIG. 3 is a plan view of the seat pad with the back element and the seat element arranged along the same plane and the cover for the back element fully extended over the seat element so as to expose and disclose the means for securing the inflatable lumbar support bladder to the back element and also means for securing the cover to the outer surface of the back element.
Figure 4:
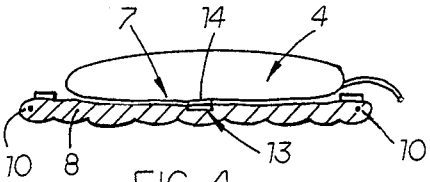
FIG. 4 is a cross-sectional view taken along the plane IV—IV and disclosing the means by which the inflatable bladder is secured to the outer surface of the back element.

Both the seat element 1 and the back element 2 are constructed so as to make a seat and back element self-supporting while at the same time providing a cushion for the person to sit on. I have found that these elements can be constructed of piano wire 10 located at and forming the marginal edges of the seat and back portions with one-half inch automotive foam, backed with fabric, forming the body, thus providing a soft and comfortable surface for both the seat and the back of the user. In this particular construction, the piano wire gives rigidity to the shape and at the same time importantly the body of the back element is flexible so that when a force is exerted on the outer surface of the body of back element, i.e., the portion between its marginal edges, the automotive foam can be deformed to take substantially the shape of the inner surface 7 of the inflatable bladder. In other words, the body 8, which is generally flat as shown in FIG. 4 when a force is not exerted on the outer surface, conforms substantially to the shape of the bladder to form a lumbar support 9 when a force is exerted on it by the cover as disclosed in FIGS. 1 and 6, particularly when a person sits in the seat pad.

The seat element 1 and back element 2 are hingedly secured together as discussed above by the fabric that forms the surfaces 6 and 12 and 11 and **11*a* of the seat and back elements. Reinforcement can be provided along the hinge line 3** depending upon the integrity of the fabric.

The bladder 4 is formed of a rubberized or plastic material that will contain air and assume a shape conducive to the back of a person. It has a length substantially the same as the width of the back element 2 and extends laterally across the surface 6 as disclosed in FIGS. 2–4 and 6.

Leading from the bladder is a tube 20 on the end of which is a bulb 21 and a valve means 22. The bulb is adapted when squeezed to inflate the bladder 4 and, when the bladder is inflated to the proper position, the valve or clamp 22 pinches the tube to retain the air within the bladder. If one desires to remove the air, the valve 22 releases the air all in any number of well-known manners.

Bladder 4 is secured to the surface 6 of back element 2 by means of an elongated strip of tape 13 extending between the lower and upper edges of the back element 2 and strip 14 located on the inner surface of bladder 4. Instead of one pair of strips located centrally of the back 2, several pairs of strips such as strips 13*a* and 13*b* shown in phantom could be utilized. In the preferred form, strip 13 cooperates with strip 14 to secure the bladder 4 to the outer surface 6. One of these strips is a hooked tape and another a napped loop tape which when forced together provide a secure attachment means. Two different types of tapes that could be used in this environment are products known as "Velcro", a trademarked product manufactured and sold by Velcro Division of American Thread, High Ridge Park, Stamford, Conn. and "Sabre Grip", another trademarked product manufactured and sold by A. Meyers & Sons, 325 W. 38th, New York, N.Y. These are tapes well known to those skilled in the art and, therefore, require no additional description.

It should be understood that, in the use of the term "hooked and napped loop means", it is meant that such means is either a hooked tape element or a napped loop tape element, the hooked tape element being adapted to cooperate with a napped loop tape element and vice versa.

As disclosed in FIG. 1, the outer surface 6 and the bladder 4 are covered by a cover 5 having the same shape and size as the outer surface of the back element 2. As disclosed in FIG. 2, the cover 5 is stitched at 15 to the outer surface 6 of the back element 2.

Figure 5:
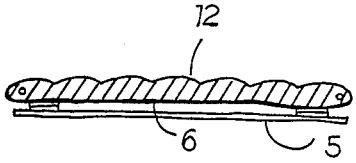
FIG. 5 is a cross section taken along the plane V—V of FIG. 1 disclosing how the cover is secured along the marginal edge of the back element.

Both the cover 5 and surface 6 have pairs of hooked and napped tape strips 16*a* and 16*b*, respectively. These strips are located at positions so that when the cover is swung down into position over the surface 6, the strips 16*a* and 16*b* contact each other and secure the cover to the back as disclosed in FIGS. 1 and 5.

OPERATION

Having disclosed the construction of my seat pad, the operation should become quite evident.

First, it will be necessary for a user to adjust the bladder into the proper position for support of the lumbar region of his spine. This is accomplished by disengaging the hooked and napped loop tape strips 16*a* and 16*b* from one another by simply pulling up on the cover so that the cover is in the position as disclosed in FIG. 2. Then the bladder is removed by disengaging strips 13 and 14. After adjusting the bladder to the proper height, strips 13 and 14 are engaged securing the bladder in position. It may take several trys before the user determines the most comfortable position for the lumbar support. This is one advantage of the present invention in that the adjustment by trial and error can be made easily and there are enumerable amounts of adjustment from the lowest to the highest positions. Further, it is extremely important that the adjustments be made in small increments so that the most satisfactory position is obtained. The hooked and napped loop tapes makes this a possibility as opposed to other possible attachment means.

When the optimum position of the bladder is obtained, the cover is stretched down into position over the surface 6 and over the bladder 4 so that the strips 16*a* and 16*b* are reengaged to hold the cover firmly in position thereby assisting in retaining the bladder in its optimum position. The operator or user then inflates the bladder or otherwise the bladder could be inflated before the adjustments are made depending upon the desires of the particular user.

As disclosed in FIG. 4, when no pressure is exerted on the body 8 of the back element 2, the body 8 is flat. However, when the seat pad is placed on a support such as a chair or an automobile seat, the bladder forces a portion of the front surface of the seat pad outwardly as disclosed in FIGS. 1 and 6 thus providing the lumbar support which can be adjusted to the optimum position for the user regardless of his or her size.

It should be evident from the above description that I have provided not only a complicated seat pad with an adjustable lumbar support but also one that is relatively inexpensive and can be adjusted for different size persons, the adjustment being in extremely small increments so that the optimum lumbar support can be obtained.

Further, it should be evident from the above description that the adjustment is a simple and easy one, and the seat pad has superior aesthetics because the bladder is hidden from view.

It should be understood that although I have described the preferred embodiment of my invention, other possible embodiments and modifications can be made to it without departing from the spirit of this invention.

The embodiments of the invention in which an exclusive property or privilege is claimed are defined as follows:

1. A seat pad with an adjustable lumbar support comprising:

a seat element and a back element pivotally secured together along the juncture formed at the rear edge of the seat element and the lower edge of the back element;

said seat and back elements each including a body having an inner surface which faces an occupant when seated on said seat pad and an outer surface which faces the support on which the seat pad is to be supported;

said body of said back element having sufficient rigidity along portions of its periphery to render said back element self-supporting in a vertical position, the intermediate portions between said peripheral portions being flexible and the outer surface being exposed to provide access thereto;

a first hooked and napped loop means secured to the said outer surface of said back element and extending between the lower and upper edges thereof;

an elongated air inflatable bladder positioned on the exposed outer surface and adjacent to the intermediate portion of said body of said back element such that the full thickness of the intermediate portion of said body is interposed between said air bladder and an occupant when said occupant is seated in said seat pad whereby inflation of said air bladder deforms the entire thickness of the intermediate portion of said body; said air bladder including a second hooked and napped loop means secured to one side thereof and cooperative with said first hooked and napped loop means for removably supporting said bladder at different selected positions on the outer surface of said back between the upper and lower edges thereof, the exposure of said outer surface providing access to said bladder for removing and adjusting said bladder to different positions on said back surface; and said back element being sufficiently flexible in its intermediate portion so as to flex in response to pressure exerted by said inflated bladder whereby when an occupant sits in said seat pad additional support is provided to the lumbar region of said occupant's back.

2. A seat pad with an adjustable lumbar support comprising:

a seat element and a back element pivotally secured together along the juncture formed at the rear edge of the seat element and the lower edge of the back element;

said seat and back elements each including a body having an inner surface which faces an occupant when seated on said seat pad and an outer surface which faces the support on which the seat pad is to be supported;

said body of said back element having sufficient rigidity along portions of its periphery to render said back element self-supporting in a vertical position, the intermediate portions between said peripheral portions being flexible and the outer surface being exposed to provide access thereto;

a first hooked and napped loop means secured to the said outer surface of said back element and extending between the lower and upper edges thereof;

an elongated air inflatable bladder positioned on the exposed outer surface and adjacent to the intermediate portion of said body of said back element such that the full thickness of the intermediate portion of said body is interposed between said air bladder and an occupant when said occupant is seated in said seat pad whereby inflation of said air bladder deforms the entire thickness of the intermediate portion of said body; said air bladder including a second hooked and napped loop means secured to one side thereof and cooperative with said first hooked and napped loop means for removably supporting said bladder at different selected positions between the upper and lower edges of the outer surface of said back element, the exposure of said outer surface providing access to said bladder for removing and adjusting said bladder to different positions on said back surface;

a cover for said outer surface of said back element for covering said bladder and assisting in holding it in any one of said selected positions;

means for removably securing said cover to the outer surface of said back; and said back element being flexible in its intermediate portion so as to flex in response to pressure exerted by said inflated bladder whereby when an occupant sits in said seat pad additional support is provided to the lumbar region of said occupant's back.

3. The seat pad of claims 1 or 2 in which said first hooked and napped loop means is comprised of at least one strip of hooked and napped loop means secured to and extending across the outer surface of said back.

4. The seat pad as recited in claim 2 wherein said means for removably securing said cover to the outer surface of said back comprises engaging means, attached to said cover and said back element, for removably fastening said cover to the outer surface of said back element.

5. The seat pad of claim 4 wherein said engaging means for removably fastening said cover to said outer surface of said back element comprises strips of hooked and napped loop tape arranged along the margins of said outer surface and cover.

6. A back element for providing support to the lumbar region of the spine of a user comprising:

a portable back support element adapted to be mounted on the back of a seat; said element including a body having an inner surface which faces an occupant when seated on said seat and an outer surface which faces the back of the seat on which the back support element is to be supported;

said body of said back element having sufficient rigidity along portions of its periphery to render said back element self-supporting in a vertical position the intermediate portions between said peripheral portions being flexible and the outer surface being exposed to provide access thereto;

a first hooked and napped loop means secured to the said outer surface of said back element and extending between the lower and upper edges thereof;

an elongated air inflatable bladder positioned on the exposed outer surface and adjacent to the intermediate portion of said body of said back element such that the full thickness of the intermediate portion of said body is interposed between said air bladder and an occupant when said occupant is seated in said seat whereby inflation of said air bladder deforms the entire thickness of the intermediate portion of said body; said air bladder including a second hooked and napped loop means secured to one side thereof and cooperative with said first hooked and napped loop means for removably supporting said bladder at different selected positions on the outer surface of said back between the upper and lower edges thereof, the exposure of said outer surface providing access to said bladder for removing and adjusting said bladder to different positions on said back surface; and said back element being flexible in its intermediate portion so as to flex in response to pressure exerted by said inflated bladder whereby when an occupant sits in said seat additional support is provided to the lumbar region of said occupant's back.

7. A back element for providing support to the lumbar region of the spine of a user comprising:

a portable back support element adapted to be mounted on the back of a seat; said element including a body having an inner surface which faces an occupant when seated on said seat and an outer surface which faces the back of the seat on which the back support element is to be supported;

said body of said back element having sufficient rigidity along portions of its periphery to render said back element self-supporting in a vertical position, the intermediate portions between said peripheral portions being flexible and the outer surface being exposed to provide access thereto;

a first hooked and napped loop means secured to the said outer surface of said back element and extending between the lower and upper edges thereof;

an elongated air inflatable bladder positioned on the exposed outer surface and adjacent to the intermediate portion of said body of said back element such that the full thickness of the intermediate portion of said body is interposed between said air bladder and an occupant when said occupant is seated in said seat whereby inflation of said air bladder deforms the entire thickness of the intermediate portion of said body; said air bladder including a second hooked and napped loop means secured to one side thereof and cooperative with said first hooked and napped loop means for removably supporting said bladder at different selected positions between the upper and lower edges of the outer surface of said back element, the exposure of said outer surface providing access to said bladder for removing and adjusting said bladder to different positions on said back surface;

a cover for said outer surface of said back element for covering said bladder and assisting in holding it in any one of said selected positions;

means for removably securing said cover to the outer surface of said back; and said back element being flexible in its intermediate portion so as to flex in response to pressure exerted by said inflated bladder whereby when an occupant sits in said seat additional support is provided to the lumbar region of said occupant's back.

8. The back element of claims 6 or 7 in which said first hooked and napped loop means is comprised of at least one strip of hooked and napped loop means secured to and extending across the outer surface of said back.

9. The back element as recited in claim 7 wherein said means for removably securing said cover to the outer surface of said back comprises engaging means, attached to said cover and said back element, for removably fastening said cover to the outer surface of said back element.

10. The back element of claim 9 wherein said engaging means for removably fastening said cover to said outer surface of said back element comprises strips of hooked and napped loop tape arranged along the margins of said outer surface and cover.

* * * * *